US005979692A

United States Patent [19]

West

[11] Patent Number: 5,979,692

[45] Date of Patent: Nov. 9, 1999

[54] BOSS FOR COMPOSITE PRESSURE VESSEL HAVING POLYMERIC LINER

[75] Inventor: Bill J. West, Chino Hills, Calif.

[73] Assignee: Harsco Corporation, Camp Hill, Pa.

[21] Appl. No.: 09/042,049

[22] Filed: Mar. 13, 1998

[51] Int. Cl.[6] ..... F17C 1/02; F17C 1/16

[52] U.S. Cl. ..... 220/586; 220/62.19; 220/62.22; 220/589; 220/592; 220/601; 220/640

[58] Field of Search ..... 220/581, 582, 220/586, 588, 589, 590, 62.19, 62.22, 601, 657, 656, 592, 642, 644, 640

[56] References Cited

U.S. PATENT DOCUMENTS

| | | | |
|---|---|---|---|
| 1,574,690 | 2/1926 | Radabaugh . | |
| 2,744,043 | 5/1956 | Ramberg . | |
| 3,293,860 | 12/1966 | Stedfeld . | |
| 3,660,593 | 5/1972 | Bowles . | |
| 3,722,538 | 3/1973 | Gezari | 220/902 |
| 3,840,139 | 10/1974 | Harmon . | |
| 3,843,010 | 10/1974 | Morse et al. . | |
| 3,907,149 | 9/1975 | Harmon . | |
| 4,085,860 | 4/1978 | Hawkins et al. . | |
| 4,115,194 | 9/1978 | Butti . | |
| 4,331,175 | 5/1982 | Brake et al. . | |
| 4,360,116 | 11/1982 | Humphrey . | |
| 4,369,894 | 1/1983 | Grover et al. . | |
| 4,504,530 | 3/1985 | Bliley . | |
| 4,538,395 | 9/1985 | Edmonds et al. . | |
| 4,625,537 | 12/1986 | Aleck . | |
| 4,690,295 | 9/1987 | Wills . | |
| 4,775,073 | 10/1988 | Webb . | |
| 5,253,778 | 10/1993 | Sirosh . | |
| 5,273,603 | 12/1993 | Park et al. . | |
| 5,287,987 | 2/1994 | Gaiser . | |
| 5,287,988 | 2/1994 | Murray . | |
| 5,332,495 | 7/1994 | Williams . | |
| 5,429,845 | 7/1995 | Newhouse et al. . | |
| 5,476,189 | 12/1995 | Duvall et al. . | |
| 5,518,141 | 5/1996 | Newhouse et al. . | |
| 5,758,796 | 3/1998 | Nishimura et al. | 220/590 |

FOREIGN PATENT DOCUMENTS

| | | |
|---|---|---|
| 25 38 433 A1 | 3/1977 | Germany . |

*Primary Examiner*—Stephen K. Cronin
*Assistant Examiner*—Niki M. Eloshway
*Attorney, Agent, or Firm*—Eckert Seamans Cherin & Mellott, LLC

[57] ABSTRACT

A boss for a pressure vessel with an outer reinforcing shell and an inner liner has a radially extending flange and a tubular neck projecting outwardly to provide a fluid communication port. The flange is embedded in and structurally integrated with the material of the inner liner during molding. The flange is divided by a conical annular groove into an outer skirt and an inner skirt. The inner skirt protrudes from the outer skirt and has a flattened end facing toward the vessel wall. The flattened end and/or the surfaces of the annular groove are textured, knurled or otherwise unevenly surfaced for gripping the liner material. A number of apertures extend from inside the groove to the opposite side of the flange. The liner material is molded on and in the groove of the flange and fills the apertures to form anchoring segments integral with the liner, extending through the flange to liner material on both sides.

11 Claims, 3 Drawing Sheets

BOSS FOR COMPOSITE PRESSURE VESSEL HAVING POLYMERIC LINER

BACKGROUND OF THE INVENTION

1. Field of the Invention

The invention relates to a boss fitting which reinforces the structural interface between the preferably filament-wound outer shell of a pressure vessel and a polymeric inner liner of the pressure vessel, and which provides a conduit for transferring fluid to or from the interior of the pressure vessel. A boss comprises a radially extending flange located at the base of an outwardly extending tubular neck. The flange is embedded in the polymeric liner and comprises an upper (axially outer) skirt and a lower (axially inner) skirt. The skirts are spaced to define an annular groove with a textured or knurled surface at the edges of its outer or open end. A plurality of radially spaced apertures extend from the inner or closed end of the groove to a flat under surface of the radially extending flange. The boss is securely integrated with the polymeric liner in a molding procedure. During molding of the polymeric liner, polymeric material flows into the groove and through the apertures, forming a plurality of polymeric anchors whereby the flange is surrounded by and embedded in the polymer on the inside and outside of the boss fitting.

2. Prior Art

It is desirable to make gas storage pressure vessels that are light in weight and yet highly resistant to fragmentation and corrosion damage. To achieve these qualities, pressure vessels can be fabricated from laminated layers such as wound fiberglass filaments or various types of synthetic filaments, bonded together by a thermosetting epoxy resin. An elastomeric or polymeric liner is provided within the filament wound shell to seal the vessel and to prevent fluids in the vessel from contacting and potentially interacting with the composite material.

Filament wound vessels can be constructed in a variety of shapes and typically are cylindrical with a partly spherical end. A boss at the end provides a flowpath to the interior and also structurally joins the internal polymeric liner to the outer composite shell in a way that prevents fluid from penetrating between the liner and the shell. The boss generally comprises a circular flange or support member at the base of a neck that protrudes axially outwardly from the end of the vessel. The support member is attached to the internal liner so as to anchor the boss to the internal liner. A port is defined along the central axis of the neck and the support member. The contents of the pressure vessel communicate with the external environment through the port.

In many applications, composite pressure vessels as described are required to contain fluids at very high pressures. The internal pressure subjects the interface of the boss, the liner and the outer shell to structural loading, which can be extreme. As pressure within the vessel is increased from ambient pressure, bearing stress is generated as the vessel tends to inflate due to the differential pressure between the vessel interior and the ambient pressure. This stress includes forces that operate between the boss and the composite shell. In addition to a stress normal to the plane of the vessel wall (i.e., in a direction that would expel the boss along a line parallel to its axis), shear stress develops between the boss and the internal liner in the plane of the vessel wall, tending to retract the liner radially away from the boss. These stresses also tend to bend the circular flange support member of the boss, outwardly of the vessel toward the center and/or inwardly toward the radial edges.

Sufficient stress can detach the boss from the liner, at least locally. Any such detachment reduces the structural integrity of the vessel, may expose the outer shell or the surfaces between the inner and outer shells to the fluid contents, may contribute to separation of the shells, and may result in leakage from the pressure vessel. It is important to anchor the boss securely to the liner to reduce the possibility of separation.

It has been proposed to include locking structures in a boss for a pressure vessel to better anchor the boss to the liner. For example, U.S. Pat. No. 5,429,845—Newhouse discloses a boss with a support flange having one or more annular grooves for gripping complementary locking tabs formed in the liner. The hub portion or throat is tapered inwardly on its outer surface, providing an inverted inclined bearing surface which engages the outer shell. U.S. Pat. No. 5,476,189—Duvall similarly discloses a boss having a radially projecting support flange with annular grooves. Duvall does not employ a tapered hub but the support flange has annular grooves which mate with tab locks formed in the liner.

Annular locking grooves are helpful to anchor the boss to the liner. However, the respective locking structures, namely the annular grooves and liner tab locks, may not prevent the liner from separating from the boss with sufficient deformation of the vessel in general and the boss in particular. The surfaces of the support flange, which are smooth but for the annular grooves, may permit relative displacement of the inner liner and the support flange under some circumstances, leading to separation.

U.S. Pat. No. 5,518,141—Newhouse discloses another design with annular grooves in the support flange for mating with tab locks in the liner. Newhouse supplements the annular groove locking structure using bolts threaded into the hub of the boss through a support dome disposed inside of the liner. The bolted support dome holds the inner locking tab on the liner captive in its locking groove to resist separation even in the event of deformation of the boss structure. It is not clear how the support dome could be inserted into the vessel and installed from inside the liner to engage over the locking tab and groove, and presumably the liner is molded after the support dome has been attached to the hub.

The foregoing patents are hereby incorporated for their teachings of alternative structures and materials for the polymer lining, the reinforcing shell and the boss.

It would be advantageous to improve the structural connection between the liner of a pressure vessel and a boss having a support flange in a manner that is relatively uncomplicated but produces a robust mechanical attachment of the liner and the boss, and is insensitive to or even improved under conditions in which stresses produce deformation of the boss and its supporting flange, such that relative displacement of the liner and the boss is substantially eliminated.

SUMMARY OF THE INVENTION

It is an object of the invention to provide a boss which improves the structural connection between the liner of a pressure vessel and an outer shell by integrating the structure of the liner with that of a support flange on the boss.

It is another object of the invention to provide a conically downward and inward annular groove in the support flange, which is penetrated by the liner material during molding and to which the liner material is structurally integrated by flow of the liner material against, into and through surface formations and through openings in the support flange.

It is a further object of the invention to enhance the mating surface between the boss and the liner of a pressure vessel by providing the boss with a textured surface.

It is another object of the invention to provide a boss which is securely and structurally integrated with an integrally formed polymeric liner of a pressure vessel, by using polymeric segments joined integrally with the liner on opposite sides of the support flange, thereby integrally anchoring the liner to the flange.

These and other objects are accomplished by a boss disposed in the opening of an end portion of a pressure vessel. The pressure vessel generally comprises a filament wound outer shell and a preferably polymeric internal liner. The boss comprises a hub or neck forming a port communicating between the interior of the vessel and the outside, and an annular support flange extending radially from the neck. The flange is embedded in the material of the inner liner during molding, so that the neck extends outwardly from the pressure vessel.

A slanted annular groove is formed in the flange, the groove dividing the flange into an upper skirt (i.e., axially outer) and a lower skirt (axially inner) spaced from one another by the groove. The annular groove slants conically inwardly relative to the axis of the boss and forms gripping surfaces which prevent movement of the boss relative to the liner in radial and vertical directions when the vessel is stressed. The lower skirt comprises a flattened upper (outer facing) surface adjacent an open end of the annular groove and a conically slanted underside extending inwardly from the edge of the flattened upper surface to a flat underside of the annular flange extending to the inside opening of the port. The gripping surfaces of the annular flange are enhanced by texturing, knurling or similar irregularities of the flat upper portion of the lower skirt and the inner surface of the annular groove, at least in the area immediately adjacent the open end of the groove.

A plurality of through apertures are provided through the annular groove along its circumference. The apertures are preferably evenly spaced angularly, and are preferably oriented in a conical direction substantially parallel to the side walls of the groove. The apertures extend through the inner radius or closed end of the annular groove to open on the underside of the annular flange, preferably in the flat underside area.

The apertures aid in structurally integrating the liner of the pressure vessel with the boss. The liner is molded onto the preformed boss. During molding the polymeric material flows into and fills the groove in the annular flange, and flows through the plurality of apertures to join integrally with the material of the liner on opposite sides of the flange. After curing, the polymeric material remaining in the apertures forms a plurality of polymeric anchors or connecting webs which extend through the flange to integrally join the polymeric material inside the annular groove to the polymeric material adjacent the underside of the annular flange. These anchors or connecting webs, like the groove, are oriented downwardly and inwardly. In the event of stress on the pressure vessel tending to force the boss axially outwardly, to bow the flange outwardly and/or to draw the liner radially away from the boss, the grooves, the flattened and textured surfaces and the connecting anchors cooperate to prevent relative movement of the liner and the boss and consequent failure of the pressure vessel.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
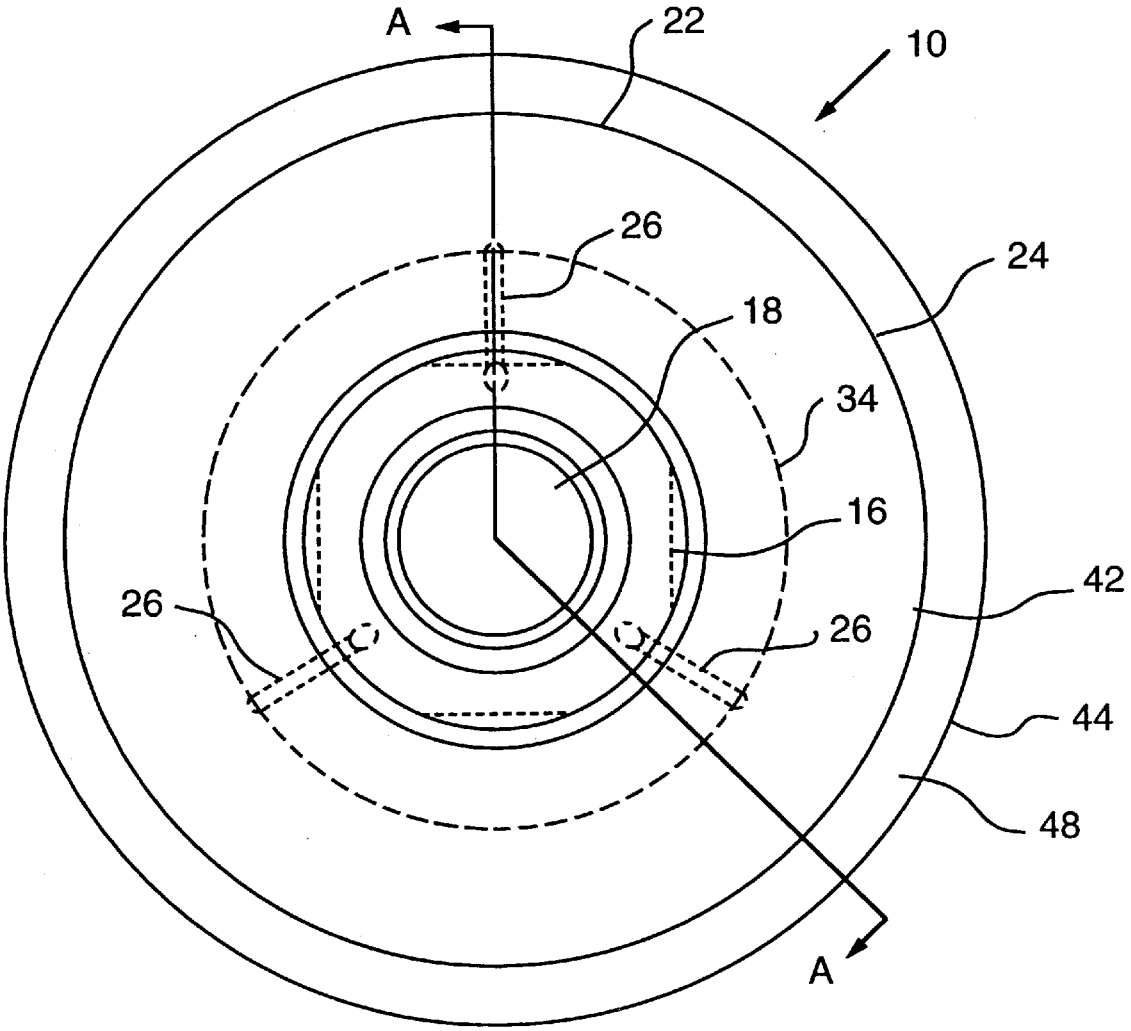
FIG. 1 is plan view of a boss according to the invention.

The invention is described in detail with reference to the accompanying drawings in which the same reference numerals are used throughout to identify corresponding elements. The drawings present the invention in an arbitrary orientation. Directional designations such as "upper" and "lower" as used in this description are intended to refer to the drawings and not to require any particular orientation.

Figure 2:
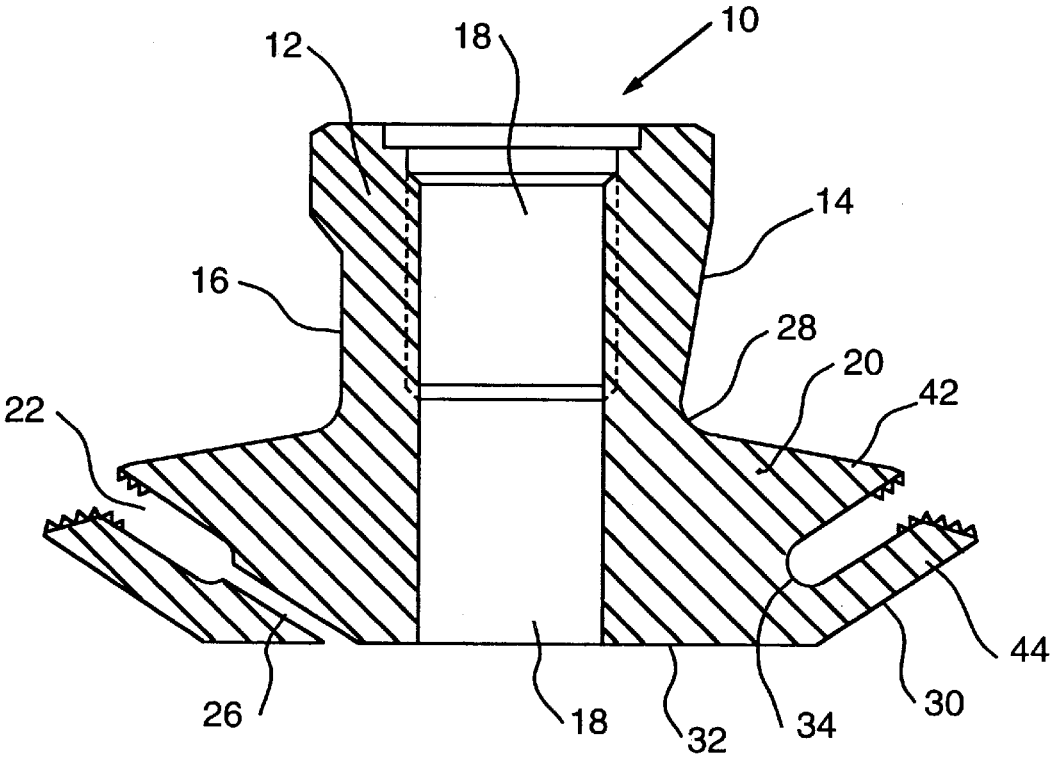
FIG. 2 is a sectional view of the boss, taken along line A—A in FIG. 1.
Figure 3:
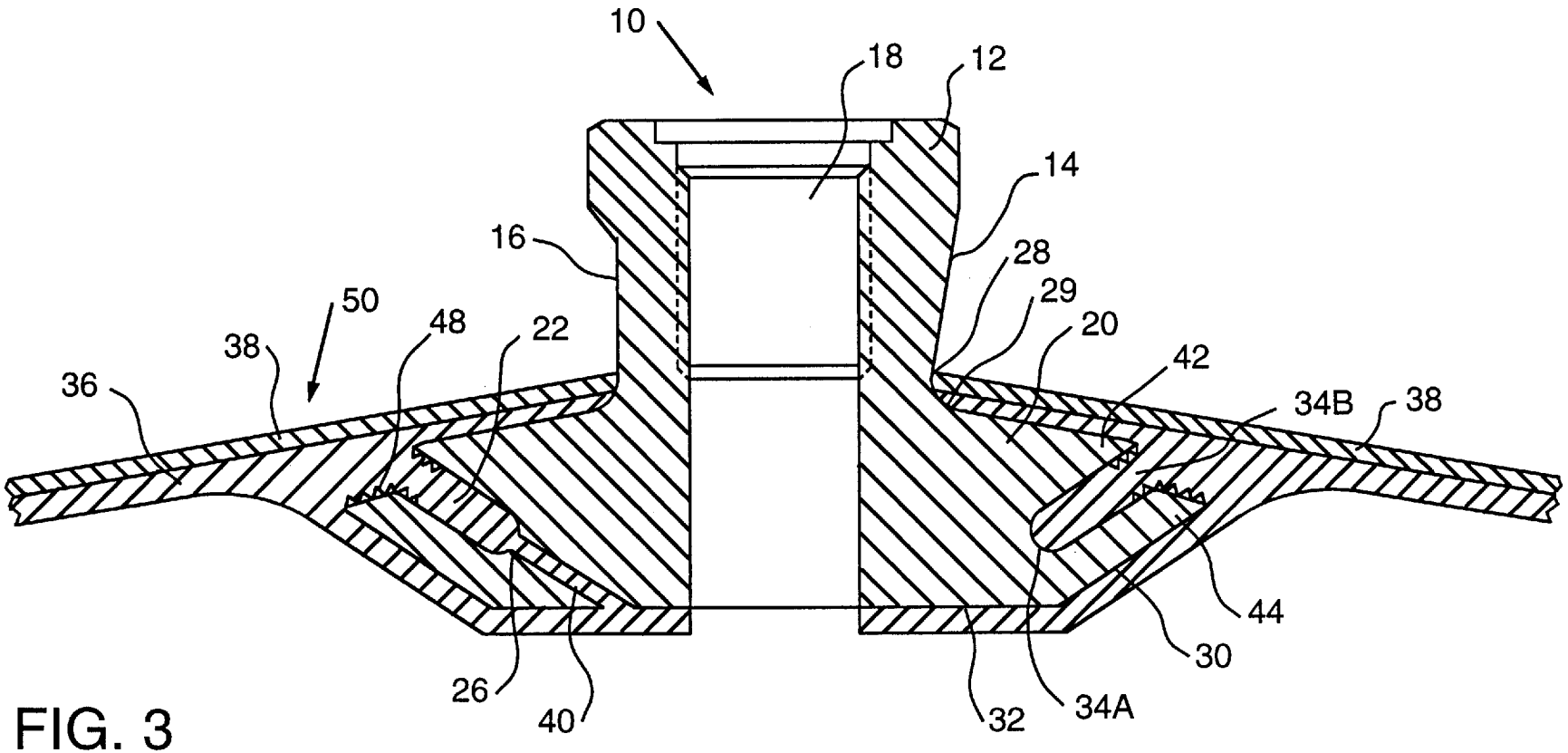
FIG. 3 is a sectional view of the boss, taken along line A—A in FIG. 1, with the boss in place in a pressure vessel.

FIGS. 1–3 show a boss 10 according to the invention. FIG. 3 illustrates the boss 10 in place, namely in the spherical end section of a partially shown pressure vessel 50. Pressure vessel 50 comprises a preferably polymeric inner liner 36 and an outer shell 38 that preferably comprises a fiber reinforcement.

Outer shell 38 of pressure vessel 50 can comprise a known composite reinforcement made of fiber reinforcing material in a resin matrix, such as fiberglass, ARAMID, carbon, graphite, or the like, or another fibrous reinforcing material capable of providing the fragmentation resistance required for the particular application in which the vessel is to be used.

The internal liner 36 is constructed from a polymeric or elastomeric material. The liner is gas impervious when cured and is constructed by compression molding, injection molding, parison molding or a similar technique in which a hardenable or curable material flows as a part of the molding process.

Boss 10 comprises an outwardly projecting hub or neck 12, which extends through an opening in the outer shell 38, and a radial or annular flange 20 located at the base 28 of neck 12. Flange 20 is embedded in liner 36 during the formation of liner 36. Neck 12 and flange 20 of boss-10 define a port 18 which extends through the center of neck 12 and flange 20. Fluid is extracted from or loaded into pressure vessel 50 through port 18. Neck 12 preferably has a downwardly and inwardly tapered outer surface 14, thereby forming a groove at the base 28 for receipt of the inner liner 36 and the fiber and resin matrix outer shell 38. Tapering surface 14 and the groove formed thereby, as backed by flange 20 inside the vessel, restrict relative displacement of the shell 38, liner 36 and neck or hub 12. Thus the structure tends to engage between boss 10 and the laminated shell 38/liner 36 vessel wall, to keep boss 10 from moving into or out of pressure vessel 50. At angularly spaced intervals around the circumference of neck 12, tapered outer surface 14 can be flattened to form a gripping surface 16 for receiving various lever or gripping devices such as wrenches, fork lift tines or the like, depending upon the size of the pressure vessel 50.

Boss 10 is mounted at a polar opening in the typically hemispherical end of an elongated pressure vessel. The radial or annular flange 20 extends from base 28 of neck 12 and provides a surface by which loads are distributed in the area of boss 10 when the vessel is pressurized.

Pressurization of the pressure vessel 50 tends to expand the vessel due to differential pressure as compared to ambient, distorting the vessel including its hemispherical end. The associated stress tends to favor relative movement in radial and axial directions between boss 10 and the vessel wall including liner 36 and shell 38. Internal pressure urges boss 10 outwardly in an axial direction relative to the vessel wall. With inflation of the vessel and resulting expansion of the hemispherical end, the vessel wall and particularly inner liner 36 are pulled radially outwardly relative to boss 10. The inflation stresses also tend to bow annular support flange 20.

Annular support flange 20 defines a slanted or angled annular groove 22, directed conically inwardly and downwardly. In the embodiment shown, the conical groove is oriented at about 60° relative to the axis of boss 10 and 40° relative to the outwardly sloping outer side of flange 20. Flange 20 provides a plurality of engagement and gripping surfaces between inner liner 36 and boss 10 to prevent relative movement between boss 10 and liner 36 in the radial and vertical directions in which stresses are produced by pressurization of the vessel.

Annular groove 22 separates radial flange 20 into an upper skirt 42 and a lower skirt 44. Referring to FIG. 2, upper skirt 42 adjacent neck 12 forms a groove 29 with the inwardly sloping tapered outer surface 14 of neck 12, located at the base of neck 12. Thus the radial dimension of neck 12 increases proceeding axially outwardly or upwardly in FIG. 2. Upper skirt 42 defines an opposed surface such that hub 10 is axially fixed relative to the vessel wall as shown in FIG. 3.

FIG. 3 shows the polymeric liner 36 and reinforced shell 38 with hub 10 in place. During formation of polymeric liner 36, for example by molding a flowable curable resin, polymeric material flows up to and against the bottom of groove 29. The filaments of reinforcing shell 38 are wrapped and woven over boss 10 to fix boss 10 relative to the vessel wall. Groove 29 acts as a bearing surface against the filament windings of outer shell 38.

Lower skirt 44 terminates in a flattened upper surface 48 adjacent to an open end 34B of annular groove 22 and has a slanted underside 30 extending inwardly from the edge of the flattened upper surface 48 to a flat underside 32 of annular flange 20. The flattened surface 28 is substantially parallel to the vessel wall but is spaced from the outer shell 38 by a relatively thick portion of polymeric liner 36. This thick portion leads continuously into the material that extends into conical groove 22.

Boss 10 is anchored to and integrated with inner liner 36 to prevent separation of liner 36 and boss 10 during pressurization of the vessel. This is accomplished by a number of surfaces of boss 10 engaging with inner liner 36, by gripping and/or abutment, and resisting lateral or axial movement of the boss 10 relative to inner liner 36. Gripping surfaces are provided including both sides of the inner and outer skirts 42, 44, namely the inner surface of annular conical groove 22, the top surface of upper skirt 42, the bottom of lower skirt 44, and the flat underside of flange 20. Abutment surfaces include the flat terminus 48 of lower skirt 44, the outer edge of upper skirt 42 and the opposite sides of flange 22. Engagement of liner 36 and the gripping surfaces of boss 10 preferably is enhanced by texturing or knurling the respective surfaces including the flattened upper surface 48 of lower skirt 44 and the inner surface of the annular groove 22, especially immediately adjacent opening 34B of groove 22.

Annular groove 22 has an open end 34B and a substantially closed inner end or radius 34A, shown in FIG. 3. A plurality of through apertures 26 are provided to extend the opening provided by annular groove 22 inwardly from the circumference of closed end 34A. Apertures 26 are preferably evenly spaced angularly around the circumference as shown in FIG. 1. Apertures 26 extend through the inner radius or closed end 34B of annular groove 22 to the flat underside 32 of annular flange 20. Inasmuch as liner 36 of the pressure vessel is molded using a flowable polymeric or elastomeric material, for example by compression or injection molding, the liner material is distributed and flows into apertures 26 during the forming process. Therefore, after molding of liner 36, flange 20 is embedded in and run through with anchoring connecting paths that couple liner material on both sides and through flange 20. Thus flange 20 and boss 10 are securely integrated with the integral material of liner 36.

Liner material extending through apertures 26 forms a plurality of polymeric anchors 40 which connect the polymeric material from inside the annular groove to the polymeric material adjacent the opposite side, namely flat underside 32, of the annular flange 20. Thus, the apertures 26 act as molds which create polymeric anchors or pins 40 which anchor liner 36 to boss 10. Apertures 26 are oriented in substantially the same direction as the walls of groove 22. Under pressurization stress, a tendency of distortion to push boss 10 axially outwardly is opposed by skirts 42, 44 and flat terminus 48, and a tendency for liner 36 to draw radially away from boss 10 is opposed by liner material held in groove 22 and also by liner material in apertures 26, extending integrally through flange 20 to lock the liner to boss 10.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. An apparatus for use in a pressure vessel having a vessel wall with an internal polymeric liner and an outer shell comprising:

a boss having a tubular neck for protruding outwardly through an opening in the vessel wall, and an annular flange on an inner end, the annular flange having an annular groove;

a port defined through the tubular neck whereby the inside of the pressure vessel communicates with an ambient environment;

wherein the annular flange has a plurality of apertures extending inwardly from an inner radius of the annular groove to an inner surface of the annular flange.

2. The apparatus of claim 1, wherein the annular flange comprises an outer skirt and an inner skirt.

3. The apparatus of claim 2, wherein the annular groove separates the outer skirt and the inner skirt.

4. The apparatus of claim 3, wherein a portion of the inner surface of an open end of the annular groove is textured for gripping engagement with the internal polymeric liner.

5. The apparatus of claim 4, wherein the inner skirt protrudes radially beyond the outer skirt and has a flattened outer facing surface adjacent the open end of the annular groove and a slanted inner surface extending inwardly from the edge of the flattened upper surface to the inner surface of the annular flange.

6. The apparatus of claim 5, wherein the flattened outer surface of the lower skirt is textured to form an irregular surface for gripping by the liner.

7. A pressure vessel, comprising:

a reinforcing outer shell and an internal polymeric liner;

a boss having a tubular neck protruding outwardly through an opening in the outer shell, a port extending through the tubular neck for communicating between an inside and an outside of the pressure vessel, an annular flange located at the proximal end of the tubular neck, the flange having a conical annular groove extending radially inward relative to the boss and axially inward relative to the port; and, wherein the flange has a plurality of apertures extending from an inner part of the annular groove to an inner side of the annular flange, and wherein the internal polymeric liner occupies the annular groove and the apertures, extending integrally into and through the flange such that the flange is structurally integrated with the inner liner.

8. The vessel of claim 7, wherein the annular flange is divided by the annular groove into an outer skirt and an inner skirt.

9. The vessel of claim 8, wherein said inner skirt extends radially beyond the outer skirt, and has a flattened outer facing surface at an open end of the annular groove and a slanted surface extending from the flattened outer facing surface to a surface of the annular flange.

10. The vessel of claim 9, wherein the flange has an irregularly textured surface at least at one of the flattened outer facing surface and an inside of the annular groove.

11. The vessel of claim 7, wherein the internal liner comprises a flowable curing polymeric material formed integrally on the flange and extending into the annular groove and through the apertures to form a plurality of polymeric anchors integral with the inner liner and extending through said apertures to connect an open end of the annular groove with an opposite surface of the annular flange.

* * * * *